United States Patent [19]

Kodama et al.

[11] 4,447,809

[45] May 8, 1984

[54] HIGH RESOLUTION FIGURE DISPLAYING DEVICE UTILIZING PLURAL MEMORIES FOR STORING EDGE DATA OF EVEN AND ODD HORIZONTAL SCANNING LINES

[75] Inventors: Kazuyuki Kodama, Kokubunji; Takeyuki Endo; Kunihiro Okada, both of Tokyo; Yasutaka Shibuya, Tachikawa, all of Japan

[73] Assignees: Hitachi, Ltd.; Hitachi Denshi Kabushiki Kaisha, both of Tokyo, Japan

[21] Appl. No.: 414,388

[22] Filed: Sep. 2, 1982

Related U.S. Application Data

[63] Continuation of Ser. No. 156,799, Jun. 5, 1980.

[30] Foreign Application Priority Data

Jun. 13, 1979 [JP] Japan ..... 54-73585

[51] Int. Cl.[3] ..... G09G 1/16

[52] U.S. Cl. ..... 340/747; 340/750; 340/801; 340/703

[58] Field of Search ..... 340/728, 723, 747, 744, 340/703, 701, 748, 749, 750, 801, 800, 798

[56] References Cited

U.S. PATENT DOCUMENTS

| | | | |
|---|---|---|---|
| 3,426,344 | 2/1969 | Clark | 340/750 |
| 3,585,627 | 6/1971 | Christopher | 340/750 |
| 3,771,155 | 11/1973 | Hayashi et al. | 340/750 |
| 3,821,730 | 6/1974 | Carey et al. | 340/750 |
| 3,999,167 | 12/1976 | Ito et al. | 340/728 |
| 4,121,283 | 10/1978 | Walker | 340/703 |
| 4,233,601 | 11/1980 | Hankins | 340/703 |

*Primary Examiner*—Marshall M. Curtis

*Attorney, Agent, or Firm*—Antonelli, Terry & Wands

[57] ABSTRACT

In a figure displaying device which generates edge data corresponding to the individual horizontal scanning lines, to display figures on the raster scanning type Braun tube relying upon the edge data, the improvement comprising at least two sets of memory groups which have a capacity corresponding to the number of picture elements at positions of even numbers and odd numbers on the horizontal scanning lines, and which store predetermined data in the addresses corresponding to the picture elements at which edges are present, at least two converter means for converting the data read in parallel from the memory groups into series data, selection means for selecting the outputs of said converter means, and control means for displaying figures on the monitor responsive to the output of said selection means.

14 Claims, 17 Drawing Figures t
τ
A
B
C
D
-1
-0.5
0
0.5
1
$y_{S\tau}$
$y_{R\tau}$
$P_\tau$
y

5
COUNTER
CP
6 MEMORY UNIT
7
T TYPE FLIP -FLOP
8
PRIORITY ENCODER
9
RAM
10
D A CONVERTER

HIGH RESOLUTION FIGURE DISPLAYING DEVICE UTILIZING PLURAL MEMORIES FOR STORING EDGE DATA OF EVEN AND ODD HORIZONTAL SCANNING LINES

This is a continuation of Application Ser. No. 156,799 filed June 5, 1980.

BACKGROUND OF THE INVENTION

1. Field of the Invention

The present invention relates to a figure displaying device such as visual scene display of the CGI (computer generated image) type, which displays figures on a Braun tube (cathode-ray tube) of the raster scanning type based upon the data prepared by an electronic computer or the like.

2. Description of the Prior Art

The figure displaying devices of this type employ a raster scan television as a monitor, and the screen on the Braun tube is successively scanned in the horizontal direction y and in the vertical direction t as shown in FIG. 1. Although most of the contents to be displayed consists of edges, it has been attempted in the past to color the displayed figures to display them as color images.

FIG. 2 schematically illustrates the formation of a figure displaying device of this type, which consists of a vector generator 1 made up of a digital differential analyzer (DDA) or the like, an edge-to-surface converter 2, a coloring circuit 3, and a TV monitor 4.

Upon receipt of the figure data from the computer, the vector generator 1 generates edges for every horizontal scanning period, i.e., generates $y_{S\tau}$ and $Y_{R\tau}$ in a horizontal scanning period $t=\tau$ as shown in FIG. 3, to form vectors AB, BC, AD and DC, i.e., to form edges of a figure ABCD in a 1-frame period. Edge data which is the result of the operation of the vector generator 1 is fed to the edge-to-surface converter 2 to convert the data into a surface pattern as indicated by $P_\tau$ in FIG. 3. The surface pattern is then colored by the coloring circuit 3 which generates a brightness signal. The brightness signal is then displayed on the monitor 4.

The edge-to-surface converter 2 employed by the above-mentioned figure displaying device contains a memory for storing the edge data generated by the vector generator 1, and a reading circuit for successively reading the contents stored in the memory.

To display the figures by the above-mentioned figure displaying device maintaining high resolution, however, the memory and reading circuit must be operated at high speeds. A limitation, however, is imposed on the operation speed. It is therefore difficult to markedly increase the resolution of the displayed figures.

SUMMARY OF THE INVENTION

The object of the present invention is to provide a figure displaying device which displays figures maintaining high resolution.

To attain the above object, the present invention provides a figure displaying device which generates edge data which indicates the positions of picture elements at which edges are present on the horizontal scanning lines of the monitor. At least two sets of memory means are provided for storing predetermined data in the addresses corresponding to the picture elements at which the edges are present based upon said edge data. A converter converts time parallel data obtained from each of said memory means into time serial data, and a controller means displays figures on the monitor responsive to the output of the converter.

and

Figure 16:
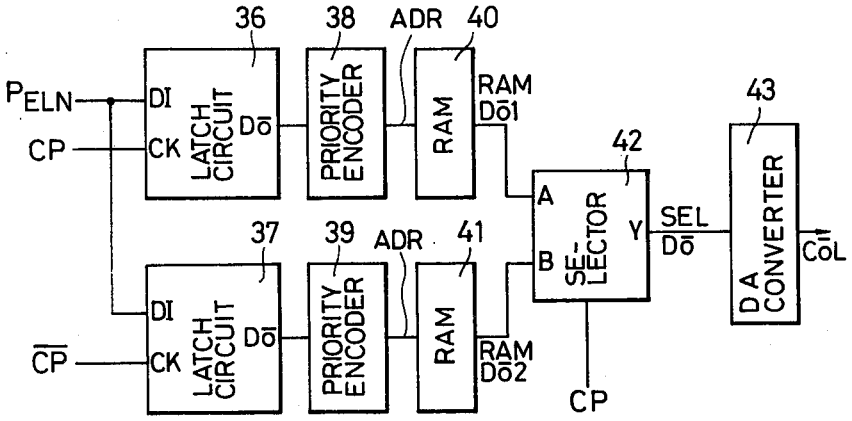
FIG. 16 is a diagram showing the setup of a coloring circuit of the figure displaying device according to the embodiment of the present invention.
Figure 17:
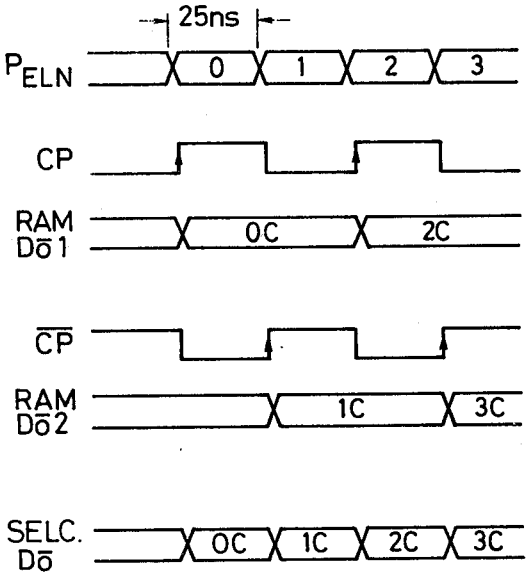

FIG. 17 is a timing chart for illustrating the operation of FIG. 16.

DESCRIPTION OF THE PREFERRED EMBODIMENTS

Figure 4:
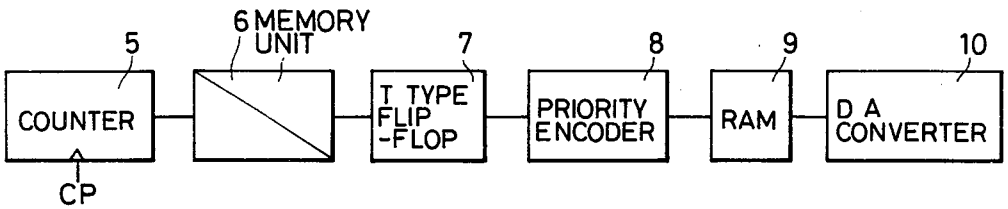
FIG. 4 is a diagram illustrating the setup of a figure displaying device according to the present invention.

FIG. 4 illustrates the formation of a figure displaying device according to the present invention, in which reference numeral 5 denotes a counter which determines an address that is to be read, 6 denotes a memory unit which includes a random access memory (hereinafter referred to as RAM) for storing edge data sent from a vector generator 1, 7 denotes a T-type flip-flop, 8 denotes a priority encoder for coloring, 9 denotes a RAM for storing color data, and 10 denotes a digital-to-analog converter (D/A converter). The memory unit 6 has two sets of memories for effecting the writing and reading. During a given period of horizontal scanning, one memory writes the data and another memory reads the data, and during the next period of horizontal scanning, one memory reads the data and another memory writes the data.

Figure 3:
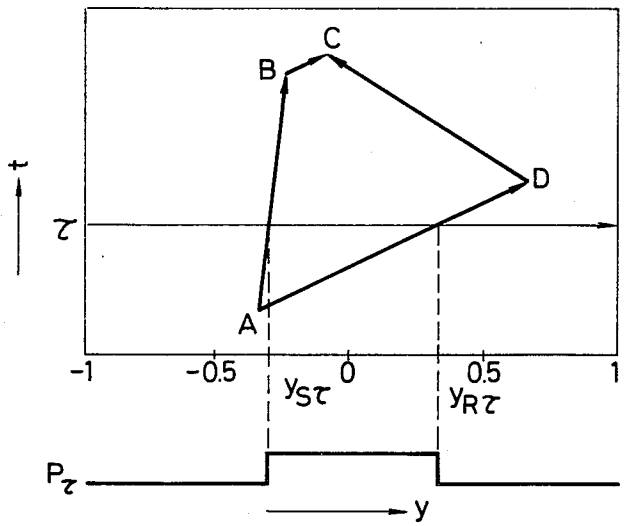
FIG. 3 is a diagram for illustrating the operation of FIG. 2.

During a given period of horizontal scanning, a data "1" is written onto a corresponding address of the memory which is in a writing mode, based upon an edge data sent from the vector generator. In the next period of horizontal scanning, the counter 5 counts clock pulses cp of a period of 50 ns which corresponds to a picture element display period. The output of the counter 5 which represents the present position in the horizontal scanning is fed as an address signal to the memory, and the stored content is read from an address of the memory specified by the address signal, so that the content is fed to the flip-flop 7. The flip-flop 7 is of the T-type which is set by a data "1" that is introduced first, and is reset by the next data "1". The flip-flop 7 therefore produces a surface pattern $P\tau$ which is illustrated in FIG. 3.

The thus obtained surface pattern $P\tau$ is then fed to the priority encoder 8. Here, the counter 5, the memory unit 6 and the flip-flop 7 have been provided for each of the colors, and their outputs are fed to the encoder 8. Therefore, the encoder 8 specifies particular colors according to a predetermined priority, whereby color data corresponding to the specified colors are read from the RAM 9, converted into luminance signals by the digital-to-analog converter 10, and are fed to the monitor.

Figure 5:
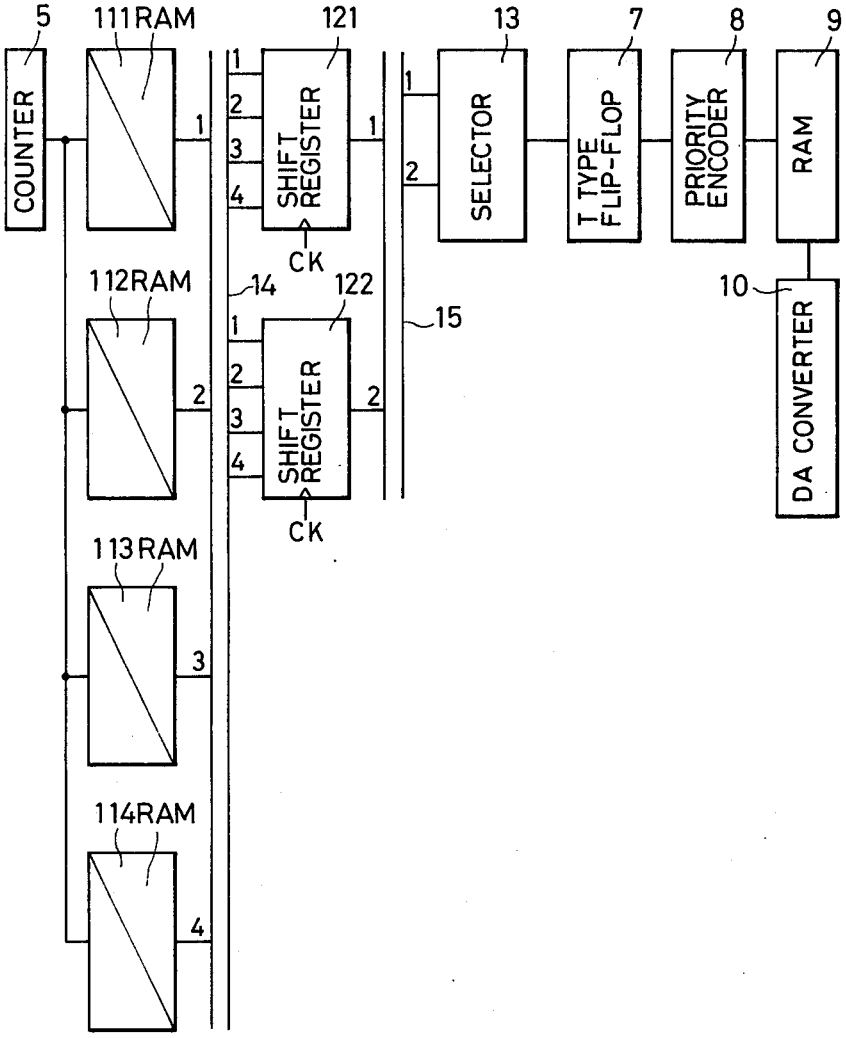
FIG. 5 is a diagram illustrating major portions of the figure displaying device according to an embodiment of the present invention.

FIG. 5 illustrates a concrete setup of an edge-to-surface converter 2 and a coloring circuit 3 which form major portions of the figure displaying device of the present invention, in which reference numerals 111 to 114 denote RAM's for storing the edge data, 121 and 122 denote shift registers which introduce inputs in parallel and produce outputs in series, 13 denotes a selector, and reference numerals 14 and 15 denote data buses. Other numerals denote the same members as those of FIG. 4. As a matter of course, each of the RAM's 111 to 114 have been provided in two sets to write and read the data.

With the thus constructed device, an edge data corresponding to a horizontal scanning line which develops subsequent to the horizontal scanning line now being scanned by the monitor is generated by the vector generator, and is fed to the RAM's 111 to 114 in the writing mode. A predetermined RAM is specified by part of the edge data to write a predetermined data "1" onto an address represented by another part of the edge data in the RAM. When the scanning by the monitor reaches the next horizontal scanning line, the data of RAM in which has been written the data of the scanning period is read out for a plurality of picture elements (four picture elements in FIG. 5) in parallel with the output of the counter 5 which represents the position in the horizontal scanning as an address, and is fed to the shift registers 121 and 122 via data bus 14. The shift registers 121 and 122 introduce the read data in parallel, shift them with shift signals CK of a period of 50 ns to convert them into series data, and send the data to the selector 13 via data bus 15. The selector 13 alternately selects the outputs of the shift registers and produces them.

The operation hereinafter is the same as that of FIG. 4.

In the case of FIG. 5, a plurality of RAM's are provided so that their outputs can be read out in parallel. Therefore, the access time of the memory can be sufficiently reduced to eliminate the problem with regard to the processing speed of the memory.

The above-mentioned setup of FIG. 5 has a resolving power of 1024 picture elements in the direction of horizontal scanning, but has only 512 scanning lines in the direction of vertical scanning. Namely, the setup of FIG. 5 has the resolving power of only 1024×512 per screen, and presents problems which stem from the lack of resolving power. For example, there often develop step effect, face crawling and face breakup, to diminish the real feeling or natural feeling.

To solve such a problem, the number of the scanning lines must be doubled in the direction of vertical scanning to increase the resolving power. If the number of the scanning lines is doubled to 1024, however, the period for one horizontal scanning becomes 31.5 μs, and the display time per picture element becomes 25 ns. Therefore, the RAM 6 or the shift registers 121, 122 must process the data at such a high speed as 25 ns per picture element, which, in practice, is in excess of the upper limit of RAM's or shift registers.

Figure 6:
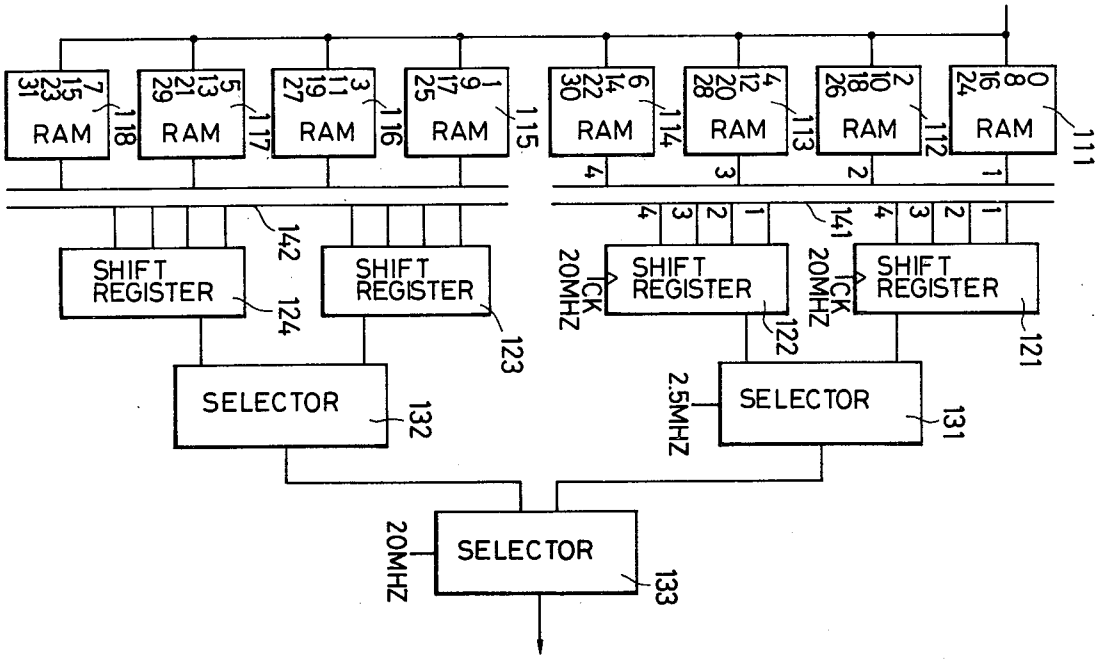
FIGS. 6 and 7 are diagrams illustrating major portions of an edge-to-surface converter of the figure displaying device according to the embodiment of the present invention.

FIG. 6 illustrates major portions of the edge-to-surface converter of the figure displaying device according to another embodiment of the present invention, which is capable of solving the above-mentioned problems. In FIG. 6, reference numerals 111 to 114 denote memory groups for storing edge data which correspond to picture elements located at positions of even numbers on the horizontal scanning lines, 115 to 118 denote memory groups consisting of RAM's for storing edge data which correspond to picture elements located at positions of odd numbers on the horizontal scanning lines, 121 and 122 denote shift registers which convert the data read in parallel from the memory groups 111 to 114 into series data, 123 and 124 denote shift registers which convert the data read in parallel from the memory groups 115 to 118 into series data, 131 to 133 denote selectors for selecting the outputs of the shift registers, and 141 and 142 denote data buses.

Each RAM of each of the memory groups is provided in two sets to write and read the data.

The circuit of FIG. 6 represents an edge-to-surface converter which displays a plane of a given color. When a plurality of planes having different colors are to be displayed, the circuit of FIG. 6 will be provided for each color.

Figure 1:
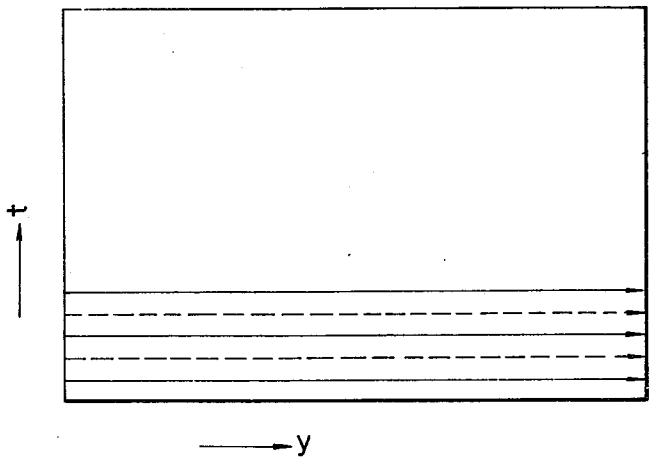
FIG. 1 is a diagram illustrating the scanning of a screen of a monitor.
Figure 2:
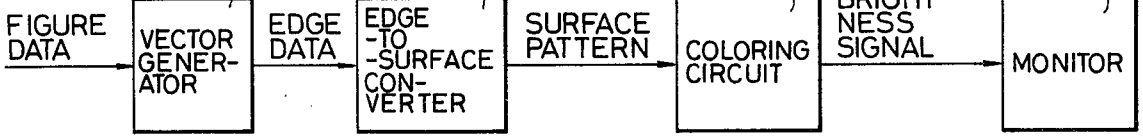
FIG. 2 is a diagram schematically illustrating the formation of a figure displaying device.

A specific data is stored in a specific address of a specific memory of the corresponding memory groups 111 to 114 or 115 to 118, depending upon whether the edge data produced by the vector generator 1 of FIG. 2 corresponds to the picture elements located at positions of even numbers or to the picture elements located at positions of odd numbers on the scanning lines.

Namely, when the edge data correspond to the picture elements located at positions of even numbers on the scanning line, the specific data is stored in the memory groups 111 to 114, and when the edge data corresponds to the picture elements located at positions of odd numbers, the specific data is stored in the memory groups 115 to 118. For example, the data of 0th, second, fourth and sixth picture elements are stored in the memories (RAM's) 111, 112, 113 and 114, and the data of first, third, fifth and seventh picture elements are stored in the memories (RAM's) 115, 116, 117 and 118.

To read the thus written data, the contents of the same addresses in the memories of all memory groups 111 to 114 and 115 to 118 are read out in parallel, and are fed to the shift registers 121, 122, 123 and 124 via data buses 141 and 142. The shift registers convert the data from the memory groups into series data and feed them to the selectors 131 and 132. The selector 131 alternately selects the outputs of the shift registers 121 and 122 depending upon the predetermined clock pulses, and the selector 132 alternately selects the outputs of the shift registers 123 and 124. The selector 133 selects the output of either one of the selector 131 or the selector 132. The selector 133 therefore successively produces reading data for each of the picture elements on the scanning lines.

Therefore, the speed for processing the data in each of the shift registers needs to be one-half of the final display speed of the picture elements, and the circuit for this purpose can be easily realized. Although the selector 133 must process the data at a speed equal to the display speed of the picture elements, it is easy to realize such a selector and there is no particular problem with this regard.

Figure 7:
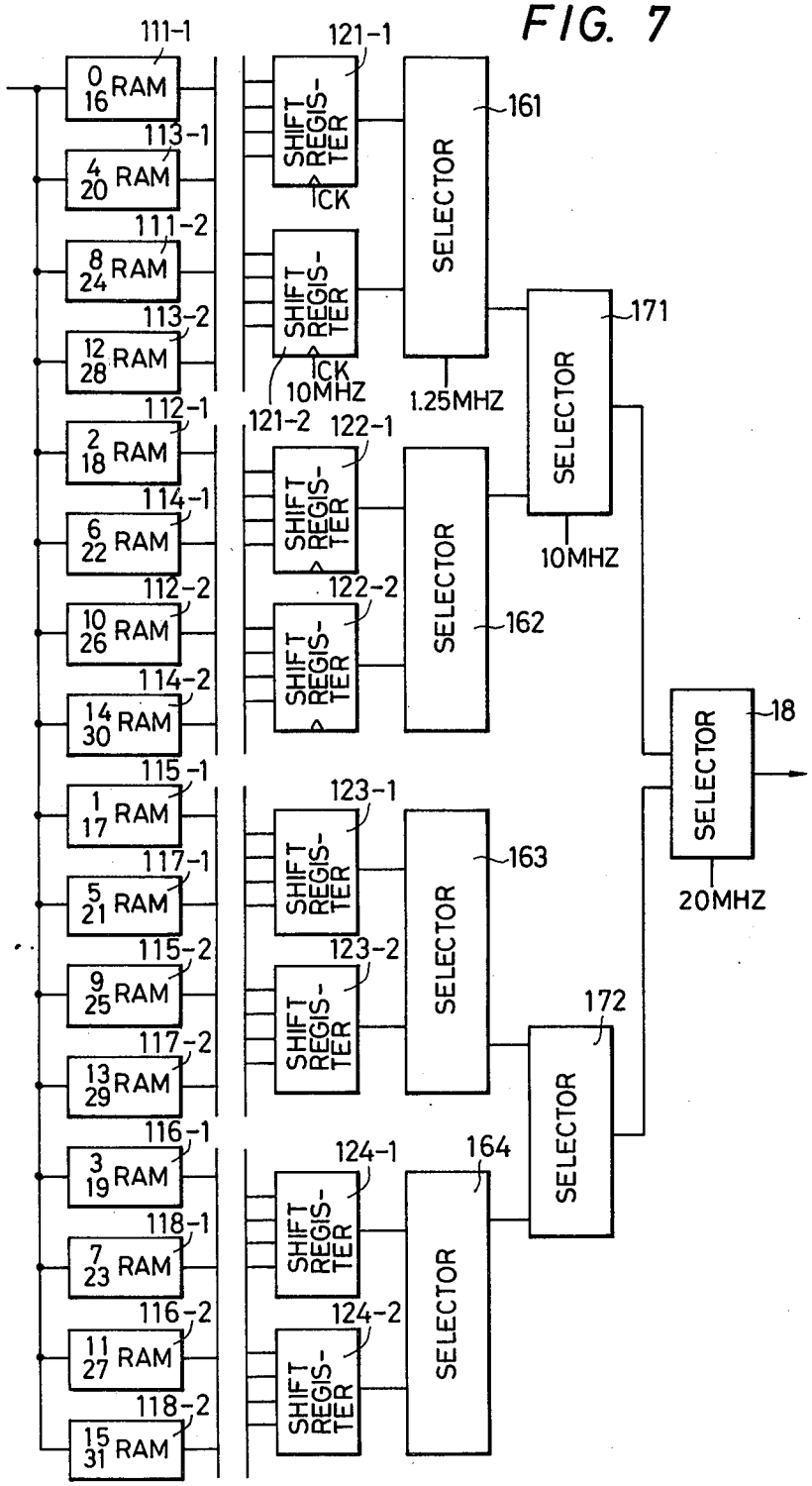

FIG. 7 illustrates major portions of the edge-to-surface converter of the figure displaying device according to a further embodiment of the present invention. What makes the embodiment of FIG. 7 different from the embodiment of FIG. 6 is that each of the memory groups 111 to 114 and 115 to 118 is further divided into two sub-groups of memory, the outputs of sub-groups 111-1, 111-2, 113-1 and 113-2 are fed to shift registers 121-1 and 121-2, the outputs of sub-groups 112-1, 112-2, 114-1 and 114-2 are fed to shift registers 122-1 and 122-2, the outputs of sub-groups 115-1, 115-2, 117-1 and 117-2 are fed to shift registers 123-1 and 123-2, and the outputs of sub-groups 116-1, 116-2, 118-1 and 118-2 are fed to shift registers 124-1 and 124-2. Reference numerals 161 to 164, 171, 172 and 18 denote selectors for selecting the outputs of the shift registers. Numerals in the memories denote numbers of the picture elements corresponding to the data that are stored therein.

Figure 8:
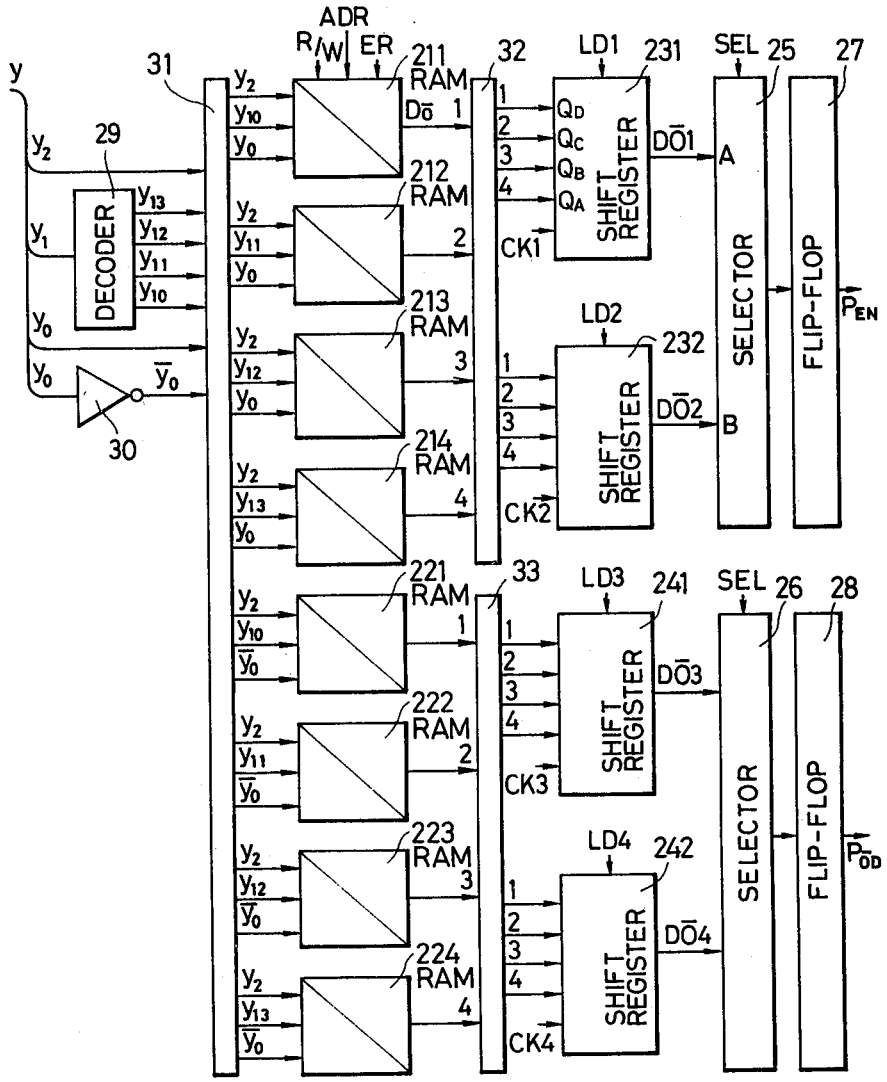
FIG. 8 is a diagram illustrating major portions of the edge-to-surface converter of the figure displaying device according to another embodiment of the present invention.

FIG. 8 illustrates the edge-to-surface converter of the figure displaying device according to still further embodiment of the present invention, i.e., illustrates a circuit for displaying figure of a given color. Therefore, to display figures of different colors, the circuit of FIG. 8 must be provided in a number equal to the number of the colors.

In FIG. 8, reference numerals 211 to 214 and 221 to 224 denote RAM's of 128 words×1 bit, 231, 232, 241 and 242 denote shift registers which introduce the inputs in parallel and produce the outputs in series, 25 and 26 denote selectors, 27 and 28 denote T-type flip-flop circuits, 29 denotes a decoder, 30 denotes an inverter, and 31, 32 and 33 denote data buses.

Each RAM is provided in two sets to write and read the data as mentioned earlier. Depending upon the control signals R/W, one memory of either one of the two sets read the data and another memory writes the data; the relation between the two memories is inverted for each period of horizontal scanning.

Figure 9:
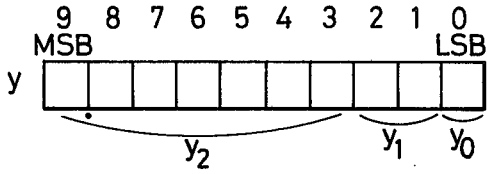
FIGS. 9, 10, 11, 12 and 13 are diagrams for illustrating the operation of the converter of FIG. 8.
Figure 10:
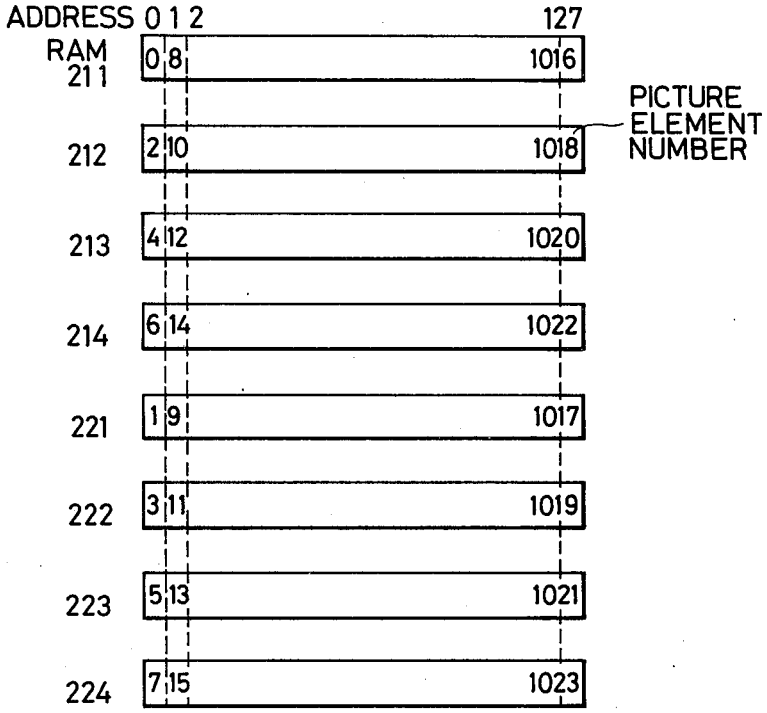

The monitor scans at a very high speed in the horizontal direction. Therefore, prior to displaying a horizontal scanning line, a surface pattern must be prepared beforehand based upon an edge data produced by the vector generator 1, i.e., based upon a value y one period before a period of the horizontal scanning line which is being displayed. Namely, the value of y such as $y_{ST}y_{RT}$ is written on the RAM's 211 to 214 and 221 to 224 one period before the period of the horizontal scanning which is being displayed. As shown in FIG. 9, the value of y is indicated by a binary number consisting of 10 bits corresponding to 1024 picture elements which determine the resolution in the direction y. Among these bits, the least significant bit $y_0$ specifies any one group among the RAM's 211 to 124 and 221 to 224, bits $y_1$ specify any RAM's among the specified RAM groups, and bits $y_2$ specify addresses of the specified RAM's. Therefore, based upon the edge data y produced by the vector generator, a data "1" is written on an address $y_2$ of a RAM which is specified by bits $y_0$ and $y_1$. For example, when y=0100000000, the data "1" is written on an address 32 of the RAM 211. When y=0100000011, the data "1" is written on an address 32 of the RAM 222. The contents of the RAM's thus obtained correspond to the picture elements on the horizontal scanning lines in the screen as shown in FIG. 10.

In this case, the following contrivance is provided.

(1) When the two vectors which form figure are in agreement as represented by a horizontal scanning line $t_a$ of FIG. 11, i.e., when $y_{ST}=y_{RT}$, the flip-flops 27 and 28 are maintained set as will be mentioned later. In this case, therefore, the data "1" is not written on the corresponding address. For this purpose, the value y of the first time, i.e., the data "1" written on the RAM at $y_{ST}$ is erased when the value y of the second time is being written, i.e., when the data is written at $y_{RT}$. Concretely speaking, the content of the address in the writing mode is read before the data is being written thereon. When the content is "1", a data "0" is written. When the content is "0", a data "1" is written.

Figure 11:
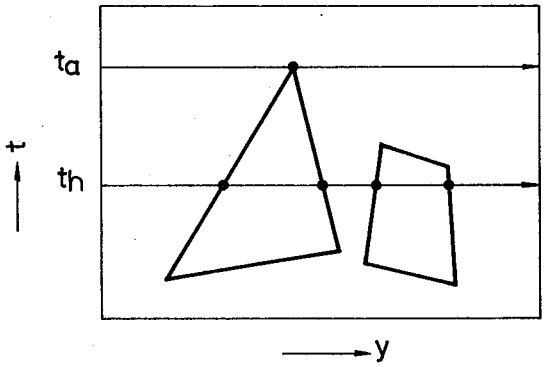

(2) When there are two or more figures of the same color, and $y_{ST}$ and $y_{RT}$ are present in a plurality of numbers as represented by a horizontal scanning line $t_b$ of FIG. 11, the data of corresponding numbers will be written on the RAM's so that many plane figures of the same color can be displayed.

In writing the data in the RAM's in FIG. 8, a bit $y_0$ in the value y is applied to the RAM groups 211 to 214 via data bus 31, an output $\overline{y}_0$ obtained by inverting the bit $y_0$ through the inverter 30 is applied to the RAM groups 221 to 224 via data bus 31, and a desired RAM group is specified by the bit $y_0$. Further, values $y_{10}$, $y_{11}$, $y_{12}$ and $y_{13}$ obtained by decoding the bits $y_1$ by the decoder 29 are fed to the RAM's 211, 212, 213 and 214 through data bus 31, and are further fed to the RAM's 221, 222, 223, and 224, thereby to specify a particular RAM in the specified RAM groups. Furthermore, the bits $y_2$ are applied to the RAM's 211 to 214 and 221 to 224, to write "1" on an address $y_2$ in the specified RAM.

Next, to read the data written onto the RAM's, the RAM's are switched from the writing mode to the reading mode after a horizontal scanning period which has introduced the value y is finished, thereby to read the data from the RAM's based upon the addresses corresponding to the quantity of horizontal scanning.

Figure 12:
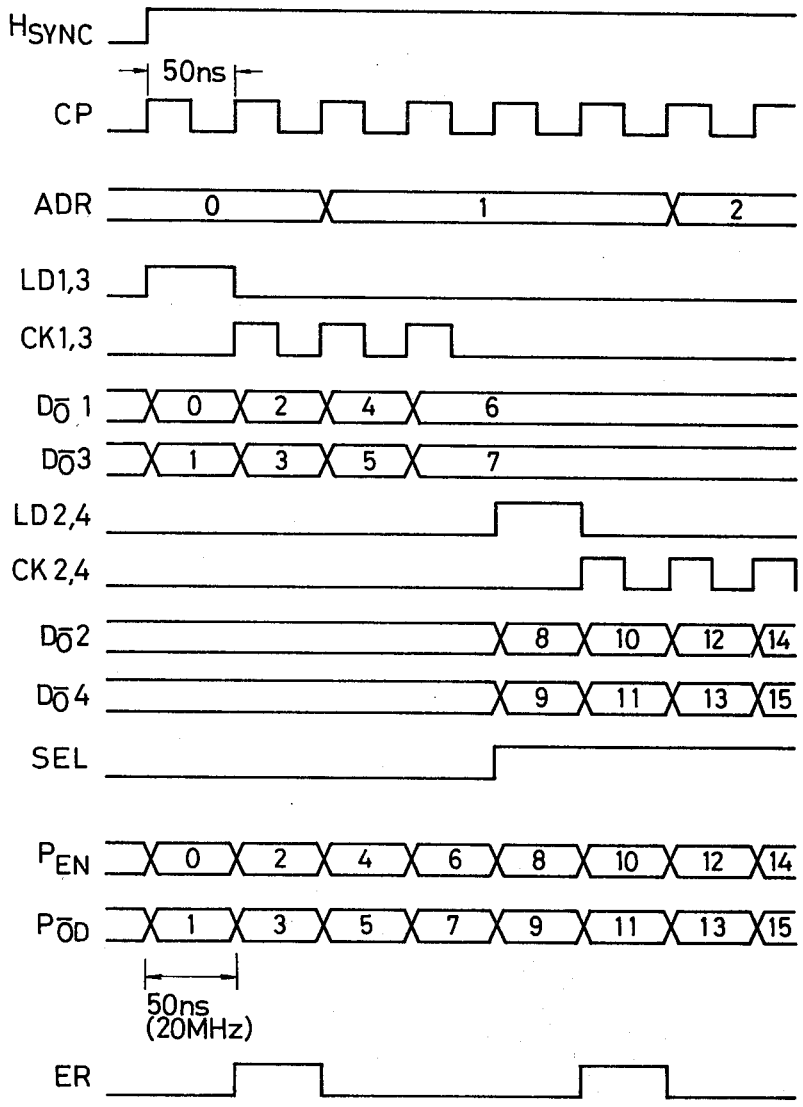

FIG. 12 is a timing chart for reading the data, in which symbol HSYNC denotes a signal which represents a period of horizontal scanning, cp denotes clock pulses having a repetitive frequency of 50 ns, ADR denotes signals for specifying reading addresses of RAM's, symbols LD1, LD2, LD3 and LD4 denote load signals for storing the data in the shift registers 231, 232, 241 and 242, symbols CK1, CK2, CK3 and CK4 denote shift signals of shift registers 231, 232, 241 and 242, symbols DO1, DO2, DO3 and DO4 denote data (indicated by picture element numbers corresponding to the data) which are produced by the shift registers 231, 232, 241, 242, SEL denotes a signal for selecting the selectors 25 and 26 $P_{EN}$ and $P_{OD}$ denote data (indicated by picture element numbers corresponding to the data) which are produced by the T-type flip-flops 27 and 28, and symbol ER denotes erasing signals for erasing the contents of the RMS's.

The reading operation is illustrated below in detail with reference to the timing chart of FIG. 12.

During a period of horizontal scanning as represented by a signal HSYNC of FIG. 12, address signals ADR are applied to the RAM's 211 to 214 and 221 to 224 in the reading mode to simultaneously read the data of the address 0 of RAM's, the data of RAM's 211 to 214 are loaded to the shift register 231 via data bus 32 responsive to load signals LD1 and LD3, and the data of RAM's 221 to 224 are loaded to the shift register 241 via data bus 33. As the signals loaded to the shift registers 231 and 241 are successively shifted by shift signals CK1 and CK3 of a period of 50 ns, there are obtained the data corresponding to the 0th picture element→second picture element→fourth picture element→sixth picture element on the horizontal scanning line in the form of outputs DO1 of the shift register 231, as well as the data corresponding to the first picture element→third picture element→fifth picture element→seventh picture element on the horizontal scanning line in the form of outputs DO3 of the shift register 241, as shown in FIG. 12. After the signals have been introduced into the shift registers as mentioned above, the contents in the address 0 of RAM's are erased by the erasing signals ER.

Then, as the address signal ADR becomes "1", the contents in the address 1 of the RAM's are read, the data of the RAM's 211 to 214 are loaded to the shift register 232 via data bus 32, and the data of the RAM's 221 to 224 are loaded to the shift register 242 via data bus 33 responsive to the load signals LD2 and LD4. As the signals loaded to the shift registers 232 and 242 are shifted by the shift signals CK2 and CK4 of the period of 50 ns, there are obtained the data corresponding to eighth picture element→tenth picture element→twelfth picture element→fourteenth picture element in the form of outputs DO2 of the shift register 232, as well as the data corresponding to nineth picture element→eleventh picture element→thirteenth picture element→fifteenth picture element in the form of outputs DO4 of the shift register 242.

On the other hand, a select signal SEL is applied to the selectors 25 and 26 to select the input at a period of 200 ns. Namely, during a period in which the select signal SEL is "0", the outputs of the shift registers 231 and 241 are selected, whereby the data of the picture elements at positions of even numbers and odd numbers among the 0th to seventh picture elements are selected by the selectors 25 and 26 and are applied to the flip-flops 27 and 28. When the select signal SEL assumes the level "1", the outputs of the shift registers 232 and 242 are selected, whereby the data of picture elements at positions of even numbers and odd numbers among the eighth to fifteenth picture elements are selected by the selectors 25 and 26, and are applied to the flip-flops 27 and 28.

Figure 13:
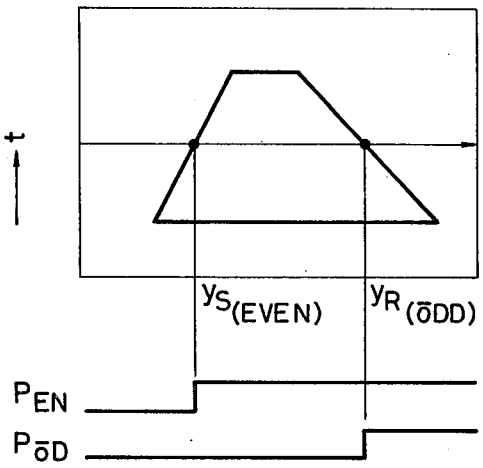

The flip-flops 27 and 28 obtain surface patterns $P_{EN}$ and $P_{OD}$ corresponding to picture elements at positions of even numbers and odd numbers on the scanning lines in the screen, as shown in FIG. 13.

Figure 14:
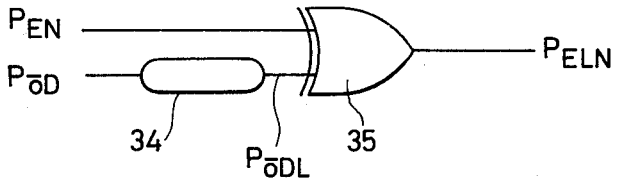
FIG. 14 is a diagram illustrating a portion by which the edge-to-surface converter of the figure displaying device of the present invention is connected to FIG. 8.

FIG. 14 illustrates the edge-to-surface converter of the figure displaying device according to yet further embodiment of the present invention, which is connected to a portion of FIG. 8.

In FIG. 14, reference numeral 34 denotes a delay line which produces at input signal by delaying it by 25 ns, and 35 denotes an exclusive OR circuit.

Figure 15:
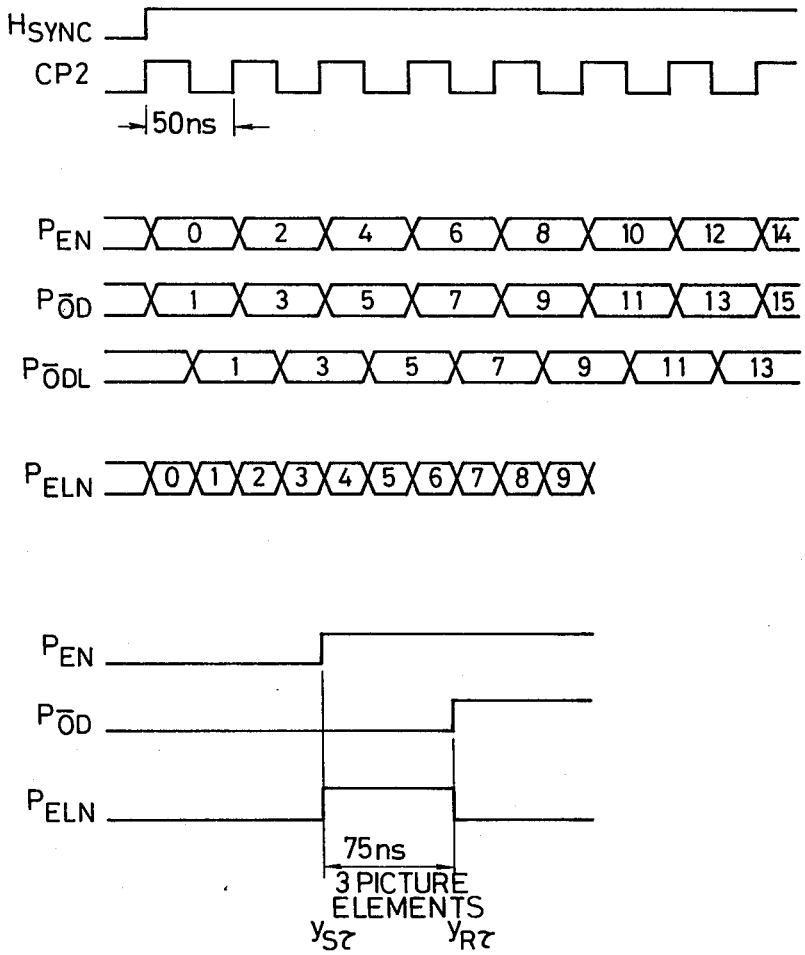
FIG. 15 is a timing chart for illustrating the operation of FIG. 14.

A complete surface pattern $P_{ELN}$ can be prepared as shown in FIG. 15 based upon surface patterns $P_{EN}$ and $P_{OD}$ which are corresponding to picture elements at positions of even numbers and odd numbers on the scanning line. That is to say, as shown in FIG. 14, the surface pattern $P_{EN}$ and a signal $P_{ODL}$ which is obtained by delaying a surface pattern $P_{OD}$ by 25 ns through the delay line 34 are fed to the exclusive OR circuit 35, thereby to obtain a complete surface pattern $P_{ELN}$ relying upon the exclusive OR of the two patterns.

The thus obtained surface patterns have a frequency of 40 MHz, i.e., a period of 25 ns, and are corresponded at a ratio of 1 to 1 with respect to the picture elements, as shown in FIG. 15. The exclusive OR circuits, in general, are capable of operating at a frequency of 40 MHz, and present no problem with regard to materializing the circuit. On the other hand, shift registers 231, 232, 241 and 242 shown in FIG. 8 operate on signals of a frequency of 20 MHz, i.e., of a period of 50 ns, and can be easily materialized by using the conventional shift registers.

Below is illustrated a concrete setup of a coloring circuit which gives color data to the thus obtained surface pattern to display it on the monitor.

A known coloring circuit consists as shown in FIGS. 4 and 5 of feeding a plurality of surface patterns for each of the colors having priority to the priority encoder 8, specifying the address of the RAM 9 storing the color data relying upon the output of the priority encoder 8, and displaying the colored pattern on the monitor based upon the output of the RAM. Such a setup, however, is not capable of operating at a frequency of 40 MHz, and it becomes difficult to display the pattern maintaining a resolving power of 1024×1024.

According to the present invention, therefore, the coloring circuit is constructed as illustrated in FIG. 16.

In FIG. 16, reference numerals 36 and 37 denote latch circuits, 38 and 39 denote priority encoders, 40 and 41 denote RAM's, 42 denotes a selector, and 43 denotes a digital-to-analog converter (D/A converter).

FIG. 17 is a timing chart for illustrating the operation of FIG. 16, in which symbol $P_{ELN}$ denotes a surface pattern, CP and $\overline{CP}$ denote clock pulses of a repetitive period of 50 ns for determining the timings at which the latch circuits 36 and 37 introduce the data, RAMD01 and RAMD02 denote output signals of RAM's 40 and 41, SELDO denotes a selector, and 42 denotes an output signal.

The operation of the circuit of FIG. 16 is illustrated below with reference to FIG. 17.

Among the surface patterns $P_{ELN}$, the data corresponding to picture elements at positions of even numbers on the scanning lines are successively introduced to the latch circuit 36 by the clock pulses CP, and the data corresponding to the picture elements at positions of odd numbers are successively introduced into the latch circuit 37 by the clock signals $\overline{CP}$. Outputs of the latch circuits 36 and 37 which are provided for each of the colors are fed to the priority encoders 38 and 39. Among the outputs of the level "1", the encoders select outputs of the circuits corresponding to the colors of highest priority and feed them as address inputs to the RAM's 40 and 41, whereby outputs RAMD01 and RAMD02 of RAM's 40 and 41 corresponding to the introduced addresses are read out, i.e., color data are read out. The selector 42 alternately selects the color data from the RAM's 40 and 41 responsive to the clock signals CP, to obtain the output signals SELDO. The output signals are then converted into analog signals through the digital-to-analog converter 43. The outputs COL of the converter 43 serve as luminance signals (R, G, B signals) for the monitor.

According to this coloring circuit, the surface patterns $P_{ELN}$ are converted into signals of a frequency of 20 MHz, i.e., of a repetitive period of 50 ns by the latch circuits 36 and 37. The circuit further reads color data from the RAM's at a frequency of 20 MHz and converts them into color data of 40 MHz, i.e., of 25 ns by the selector 42.

In this case, it is easy to operate the latch circuits, priority encoder and RAM's at a frequency of 20 MHz.

The selector 42 stably operates at 40 MHz. Further, the color data consists of a few bits per primary color. Therefore, it is easy to realize a digital-to-analog coverter which operates at 40 MHz.

According to the present invention as will be understood from the aforementioned embodiments, figures can be stably displayed maintaining a resolving power of 1024×1024 without the need of employing high-speed clock pulses of a frequency of 40 MHz.

What is claimed is:

1. A figure displaying device comprising:

generator means for generating edge data which indicate the positions of picture elements at which edges are present on horizontal scanning lines of a monitor;

at least two sets of memory groups which correspond to picture elements located at even numbers and odd numbers on each horizontal scanning line, respectively, and which store predetermined data in the addresses corresponding to the picture elements at which edges are present;

at least two deriving means for individually deriving data stored in said addresses of said two sets of memory groups corresponding to the picture elements located at the positions of even numbers and odd numbers on each horizontal scanning line;

selection means for alternately selecting the outputs of said deriving means; and control means for displaying figures on the monitor responsive to the output of said selection means.

2. A figure displaying device according to claim 1, wherein each of said two sets of memory groups has a plurality of memories and each of said two deriving means includes converter means for converting the data read in parallel from each set of memory groups into series data.

3. A figure displaying device according to claim 2 wherein said converter means comprises shift registers which introduce the inputs in parallel and produce the outputs in series.

4. A figure displaying device according to claim 2 or 3, wherein said control means comprises at least two T-type flip-flops, each of which is set by the predetermined data derived first by said deriving means through said selection means and reset by the next predetermined data derived by said deriving means through said selection means, a delay circuit which delays the output of either one of said flip-flops by a predetermined period of time, and a logic circuit which produces an exclusive OR based upon the output of said delay circuit and the output of the other of said flip-flops.

5. A figure displaying device according to any one of claims 2 or 3, wherein said control means comprises latch circuits that are provided in two sets for each of the colors that are to be displayed, said latch circuits being designed to store the data which correspond to the picture elements at positions of even numbers and odd numbers on the horizontal scanning lines among the outputs of said selection means, two sets of priority encoders which select the outputs of said latch circuits according to a predetermined order of priority, two sets of memory means for reading color data with the outputs of said encoders as address signals, and means which selects the outputs of said memory means to display figures on the monitor.

6. A figure displaying device comprising:

generator means for generating edge data which indicate the positions of picture elements at which edges are present on horizontal scanning lines of a monitor;

at least two sets of memory groups which correspond to picture elements located at even numbers and odd numbers on each horizontal scanning line, respectively, and which store predetermined data in the addresses corresponding to the picture elements at which edges are present;

at least two deriving means for individually deriving data stored in said addresses of said two sets of memory groups corresponding to the picture elements located at the positions of even numbers and odd numbers on each horizontal scanning line;

selection means for alternately selecting the outputs of said deriving means; and control means for displaying figures on the monitor responsive to the output of said selection means, including edge data converting means for converting selected edge data derived from said selection means into a surface pattern signal representative of a surface pattern defined on said monitor by respective edges present on the monitor.

7. A figure displaying device according to claim 6, wherein each of said two sets of memory groups has a plurality of memories and each of said two deriving means includes converter means for converting the data read in parallel from each set of memory groups into series data.

8. A figure displaying device according to claim 6, wherein said control means further includes means for providing color signals to said monitor in accordance with said surface pattern signal.

9. A figure displaying device according to claim 6, wherein said edge data converting means comprises a flip-flop circuit coupled to the output of said selection means which is set when said selection means indicates that a first edge is present at a first picture element location and which is reset when said selection means indicates that a second edge is present at a second picture element location.

10. A figure displaying device according to claim 6, wherein said control means comprises at least two T-type flip-flops, each of which is set by the predetermined data derived first by said deriving means through said selection means and is reset by the next predetermined data derived by said deriving means through said selection means, a delay circuit which delays the output of either one of said flip-flops by a predetermined period of time, and a logic circuit which produces an exclusive OR based upon the output of said delay circuit and the output of the other of said flip-flops.

11. A figure displaying device comprising:

generator means for generating edge data which indicate the positions of picture elements at which edges are present on horizontal scanning lines of a monitor;

at least two sets of memory groups which correspond to picture elements located at even numbers and odd numbers on each horizontal scanning line, respectively, and which store predetermined data in the addresses corresponding to the picture elements at which edges are present;

at least two deriving means for individually deriving data stored in said addresses of said two sets of memory groups corresponding to the picture elements located at the positions of even numbers and odd numbers on each horizontal scanning line;

selection means for alternately selecting the outputs of said deriving means; and control means for displaying figures on the monitor responsive to the output of said selection means, including edge data converting means for converting selected edge data derived from said selection means into a surface pattern signal representative of a surface pattern defined on said monitor by respective edges present on the monitor.

12. A figure displaying device according to claim 1, further comprising means coupled to said memory groups for writing data into a first set of said memory groups when a second set of said memory groups is being read out of through said selecting means and for writing into said second set of said memory groups when said first set of said memory groups is being read out of through said selecting means.

13. A figure displaying device according to claim 6, further comprising means coupled to said memory groups for writing data into a first set of said memory groups when a second set of said memory groups is being read out of through said selecting means and for writing into said second set of said memory groups when said first set of said memory groups is being read out of through said selecting means.

14. A figure displaying device according to claim 11, further comprising means coupled to said memory groups for writing data into a first set of said memory groups when a second set of said memory groups is being read out of through said selecting means and for writing into said second set of said memory groups when said first set of said memory groups is being read out of through said selecting means.

* * * * *